US007614533B2

(12) United States Patent
Boal et al.

(10) Patent No.: US 7,614,533 B2
(45) Date of Patent: Nov. 10, 2009

(54) COMBINATION DIAPER BAG AND INFANT CARRIER

(76) Inventors: Kimi L. Boal, 13929 - 25th Ave. SE., Bothell, WA (US) 98012; Julia K. Young, 4558 - 4th Ave. NE., Seattle, WA (US) 98105

( * ) Notice: Subject to any disclaimer, the term of this patent is extended or adjusted under 35 U.S.C. 154(b) by 418 days.

(21) Appl. No.: 11/243,199

(22) Filed: Oct. 4, 2005

(65) Prior Publication Data

US 2007/0175934 A1 Aug. 2, 2007

Related U.S. Application Data

(60) Provisional application No. 60/669,710, filed on Apr. 8, 2005.

(51) Int. Cl.
*A61G 1/00* (2006.01)
*A45F 4/00* (2006.01)

(52) U.S. Cl. ..... 224/159; 224/577

(58) Field of Classification Search ..... 224/158–161, 224/625, 626, 604, 605, 637; 383/84
See application file for complete search history.

(56) References Cited

U.S. PATENT DOCUMENTS

| | | | | | |
|---|---|---|---|---|---|
| 3,297,119 | A * | 1/1967 | Viol | 190/8 |
| 4,068,786 | A | 1/1978 | Taniguchi | 224/6 |
| D253,135 | S | 10/1979 | Fontana | D3/31 |
| 5,224,637 | A * | 7/1993 | Colombo | 224/159 |
| 5,292,042 | A | 3/1994 | Yamaguchi et al. | 224/159 |
| 5,492,256 | A * | 2/1996 | Ive | 224/159 |
| 5,529,230 | A * | 6/1996 | Smith | 224/625 |
| 5,657,912 | A | 8/1997 | Nakayama | 224/159 |
| D388,954 | S | 1/1998 | Nakayama | D3/213 |
| 5,711,466 | A * | 1/1998 | Kataoka et al. | 224/159 |
| 5,934,528 | A * | 8/1999 | Higuchi | 224/159 |
| 6,325,259 | B1 * | 12/2001 | Tharalson et al. | 224/161 |
| 2006/0113337 | A1 * | 6/2006 | Yoshie et al. | 224/159 |

FOREIGN PATENT DOCUMENTS

| | | |
|---|---|---|
| GB | 2260687 | 4/1993 |

* cited by examiner

*Primary Examiner*—Nathan J Newhouse
*Assistant Examiner*—Corey N Skurdal
(74) *Attorney, Agent, or Firm*—Dean A Craine

(57) ABSTRACT

A combination diaper bag and infant carrier that includes a bag structure with a top opening, front and rear sidewalls, two end walls, a bottom surface and a flat top surface. Attached to the front edge of the top surface is a folding main cover with an interior pouch. Attached to the rear edge of the top surface is a folding waist flap with a longitudinally aligned adjustable primary strap. When used as a diaper bag, the front and side edges of the waist flap are selectively attached to the top surface thereby holding the strap's transverse axis in a horizontal alignment. An adjustable secondary strap is securely attached to the inside surface of the interior pouch. When used as an infant carrier, the waist flap is folded upward, thereby disposing the primary strap's transverse axis in a vertical alignment that can be worn around the waist. The main cover is folded upward and the secondary strap is pulled from the pouch and extended around the neck to support an infant sitting on the bag structure.

19 Claims, 6 Drawing Sheets

COMBINATION DIAPER BAG AND INFANT CARRIER

This patent application is based on the provisional patent application Ser. No. 60/669,710 filed on Apr. 8, 2005.

BACKGROUND OF THE INVENTION

1. Field of the Invention

This invention relates to the field of diaper bags and more particularly to diaper bags capable of being converted and used as an infant hip carrier.

2. Description of the Related Art

A copious variety of diaper bags and infant carriers exist on the market today. Such diaper bags normally include a shoulder strap that enables the bag to be carried over the shoulder or across the shoulder as the infant is held in the adult's arms. When carrying an infant long distances, such as in a park or in a retail store, it is common to place the infant in a carrier to assist the parent or guardian as he or she walks while carrying an infant or small child. There are a variety of carrier styles that provide several modes of carrying an infant or small child including in the front, on the hip, in a reclined position, or on the back of an adult.

Transporting an infant outside the home, often requires the parent or caregiver to bring along numerous items, such as diapers, a changing pad, wipes, extra clothes, food, and toys in addition to essential parent's or caregiver's valuables such as a wallet, keys, a cell phone, and the like. Trying to fit most of the child's and adult's belongings into a small pouch or pocket is impractical and at best inconvenient.

It is common to witness parents or caregivers juggle both a diaper bag and a carrier while getting tangled in multiple straps as they try to provide on-the-go care for their infant or small child. The result is that, many parents will either forgo the carrier or the diaper bag to simplify their journey outside the home. However, this is more of an unfavorable compromise than a solution.

Infants and small children are 'high maintenance' and leaving a diaper bag behind may result in ending an outing sooner than anticipated if for example, a child requires a new diaper, change of clothes, food, a favorite toy, etc. On the other hand, deciding to forgo or forgetting to bring a carrier can make it difficult to make a spontaneous trip to the mall, or a bookstore, or a short stroll on a beach or park because carrying an infant or small child is stressful on the back and arms without the assistance of a carrier especially when a stroller is not always practical such as on stairs, buses, airplanes, escalators, etc.

Furthermore, toddlers often wish to practice their newly acquired walking skills so a carrier device is not always needed, yet, the convenience of having a hip carrier right at ones finger tips is extremely useful.

What is needed is a diaper bag that selectively converts into an infant hip carrier without compromising access to various items stowed in the diaper bag.

SUMMARY OF THE INVENTION

It is an object of the present invention to provide a fully-functional, lightweight diaper bag that can be worn in two modes, either over or across an adult's shoulder.

It is another object of the present invention to provide such a diaper bag that can be quickly and easily converted into an infant or small child hip carrier without disturbing the items in the diaper bag, while maintaining full access to the items in the bag when used as a hip carrier.

It is yet a further object of the present invention to provide such a diaper bag that when converted into an infant carrier, provides comfortable support for the child's backside, legs, buttocks, and back.

These and other objects are met by the combination diaper bag and infant hip carrier invention disclosed herein that includes a pear-shaped bag structure with a front panel with a front opening formed thereon, a rear panel, two opposite side panels, a bottom panel and a flat top panel. Longitudinally aligned and attached to the front edge of the top panel is a flexible main cover that hangs downward over the front panel when the bag structure is used as a diaper bag. The front opening provides access to a main storage area located inside the bag structure. Suitable connectors are provided on the inside surface of the main cover and outside surface of the bag structure to hold the main cover in a closed position over the front panel.

Formed on the inside surface of the main cover is a pouch opening that provides access to an interior pouch formed inside the main cover. Located inside the interior pouch is an adjustable secondary strap. The opposite ends of the secondary strap are attached to the inside seams or edges of the interior pouch. When the bag structure is used as an infant carrier, the main cover is folded upward and the interior pouch in inverted so that the secondary straps are exposed.

Attached to the rear edge of the top panel is a waist flap that connects to a primary strap that extends either around the user's neck or shoulder when the bag structure is used as a diaper bag or around the user's waist when used as an infant carrier. When the bag structure is used as a diaper bag, the waist flap folds downward over the top panel. Disposed between the waist flap and the top panel is a means for selectively holding the waist flap in a downward position. When the bag structure is used as an infant carrier, the front and side edges of waist flap are detached from the top panel so that the primary strap may be worn around the user's waist.

When the waist flap is folded upward, the primary strap is extended around the user's waist, the main cover is then detached from the front panel of the bag structure and folded upward. The interior pouch on the main cover is pulled outward and fully inverted so that the secondary strap is exposed. An infant or small child may now be placed onto the top panel. As the infant or child is against the adult's torso, his or her legs are able to comfortably straddle the waist flap. The secondary strap is then pulled from the interior pouch and extended over the infant's head and over the adult's head and shoulder. The secondary strap is adjusted in length so that the main cover holds the infant or child closely against the adult's body.

As mentioned above, the bag structure is pear-shaped with a narrow, top panel and a lower wide bottom panel. Formed inside the bag structure is a main storage area and an optional lower, horizontally aligned bottom pocket. Also formed on the bag structure are two side pockets and a rear pocket designed to hold various items needed when caring for an infant, such as diapers, wipes, extra clothes, food, and toys, as well as adult's valuables such as keys, wallet, and cell phone. The bag structure's pear-shaped design, the shape of the main cover with an interior pouch, the use of a waist flap attached along one edge to the top panel with a primary strap attached thereto, and a secondary strap attached at is opposite ends to the inside surface of the interior pouch, allows an adult to place or remove items from the bag structure regardless of how the bag structure is used.

DESCRIPTION OF THE PREFERRED EMBODIMENT(S)

Figure 1:
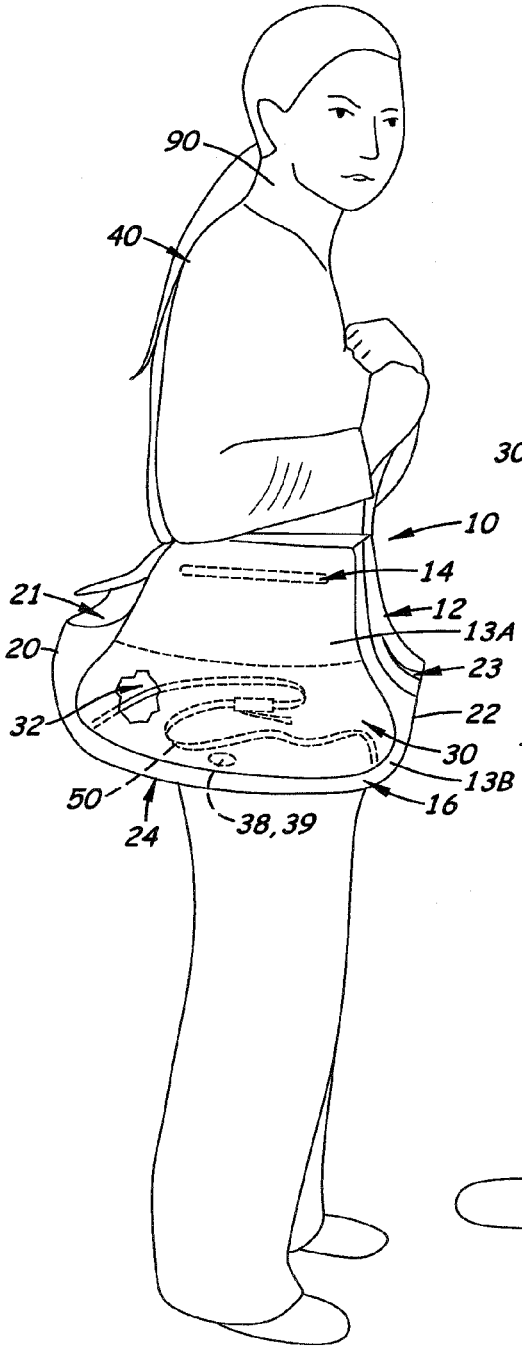
FIG. 1 is an illustration showing the combination diaper bag and infant carrier being used as a diaper bag and transported around on the shoulder of a user.

Shown in the accompanying FIGS. 1-8, there is shown a combination diaper bag and infant carrier generally denoted as 10. The carrier 10 includes a main bag structure 12 that includes a main opening 14 with a top flat 15, a front panel 16, a rear panel 18, two opposite side panels 20, 22, a bottom panel 24 and a flat top panel 26. Attached to the front edge of the top panel 26 is a folding main cover 30. Attached to the rear edge of the top panel 26 is a folding waist flap 35. Attached to the waist flap 35 is a longitudinally aligned adjustable primary strap 40 which is selectively attached in a folded position over the top panel 26 via a slide connector 37. The bag structure 12 includes a main pocket 60 and at least one side pocket 23 or 21 and a back pocket 62 designed to hold various items needed when caring for an infant, such as diapers, wipes, and clothing, as well as adult's valuables such as a wallet, keys, and a cell phone.

The main cover 30 includes an interior pouch 32 that houses an adjustable secondary shoulder strap 50. The opposite ends 52, 54 of the secondary shoulder strap 50 are securely attached to the opposite corners of the seam between the pouch 32 and the main cover 30. When used as a diaper bag, the primary strap 40 is placed over the shoulder so that the bag structure 12 hangs downward against the user's leg or hip as shown in FIG. 1. The main cover 30 is folded downward and covers the front panel 16 and the top opening 14. Suitable connectors 38, 39, such as snap connectors or hook and loop connectors, are provided between the inside surface of the main cover 30 and outside surface of the bag structure 12, respectively, to keep the main cover 30 in a closed position.

Also, when used as a diaper bag, the waist flap 35 is folded downward over the top panel 26 of the bag structure 12. The front edge of the waist flap 35 is held in position with a slide connector, a snap connector or hook and loop connectors. The portion of the primary strap 40 attached to the waist flap 35 is horizontally aligned thereby enabling the primary strap 40 to be extended upward and disposed in a flat configuration over the shoulder.

Figure 2:
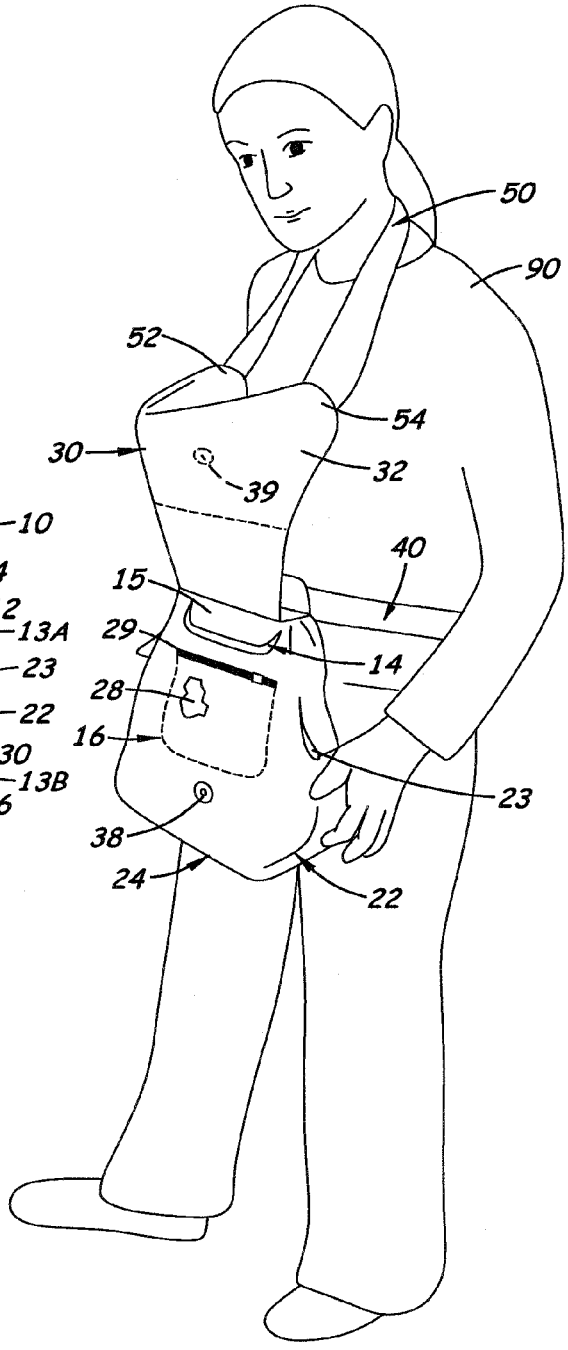
FIG. 2 is an illustration showing the combination diaper bag and infant carrier being used as an infant carrier.
Figure 3:
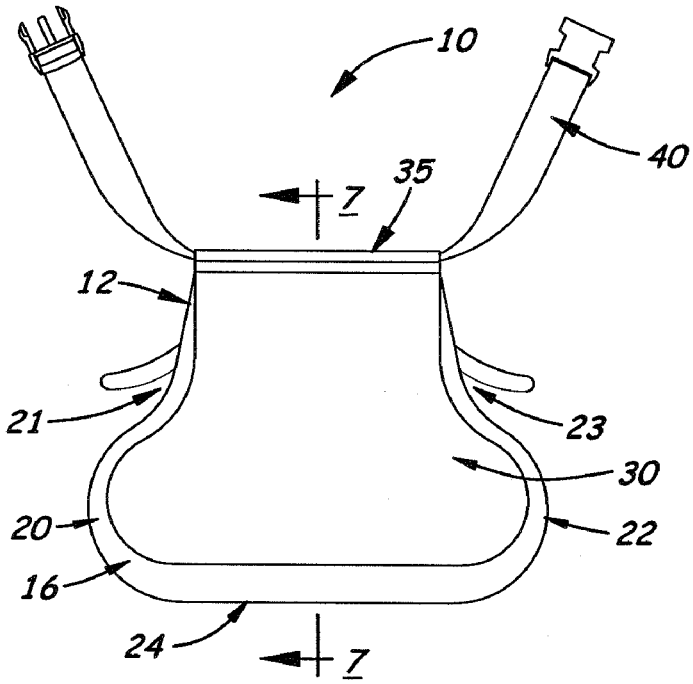
FIG. 3 is a front side elevational view of the bag structure being used as a diaper bag.
Figure 4:
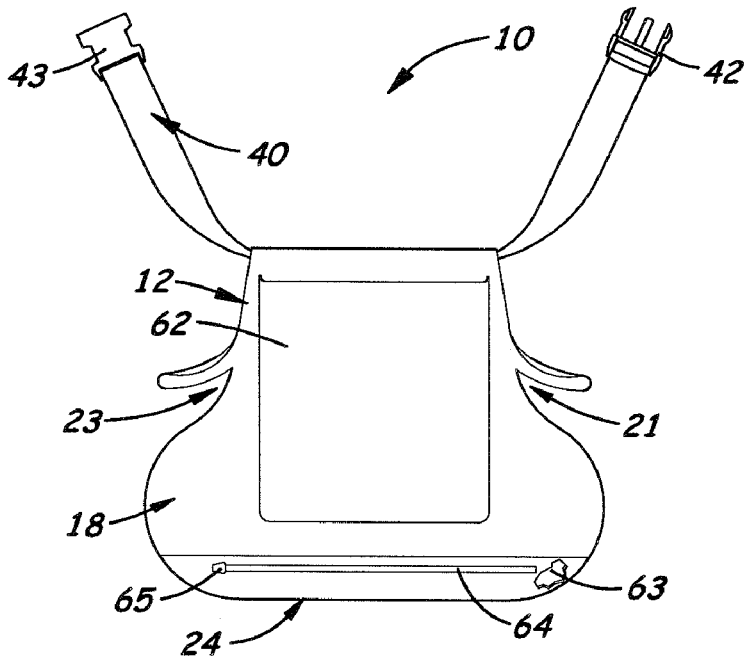
FIG. 4 is a rear side elevational view of the bag structure being used as a diaper bag.
Figure 5:
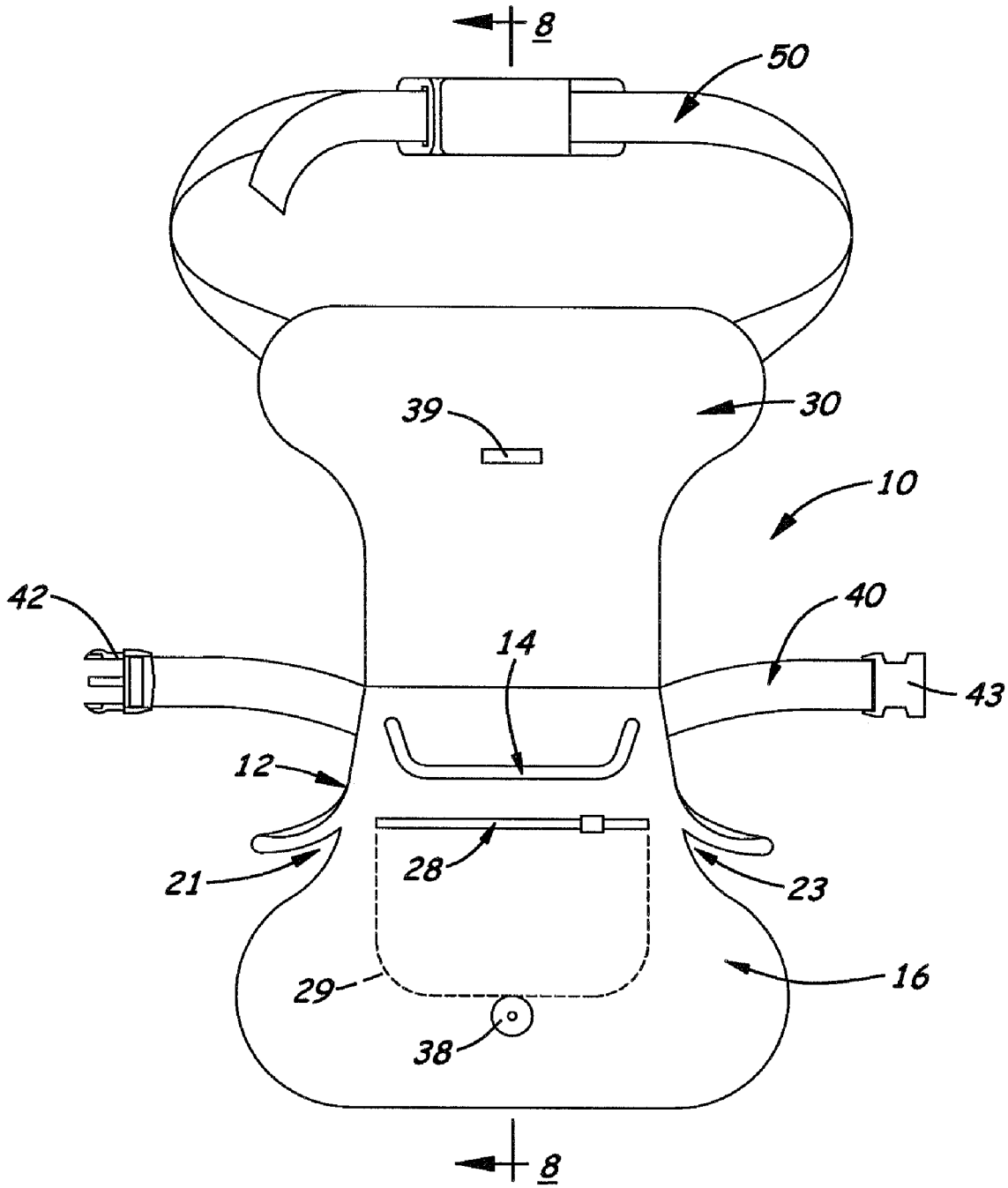
FIG. 5 is a front elevational view of the bag structure unfolded into an infant carrier.
Figure 6:
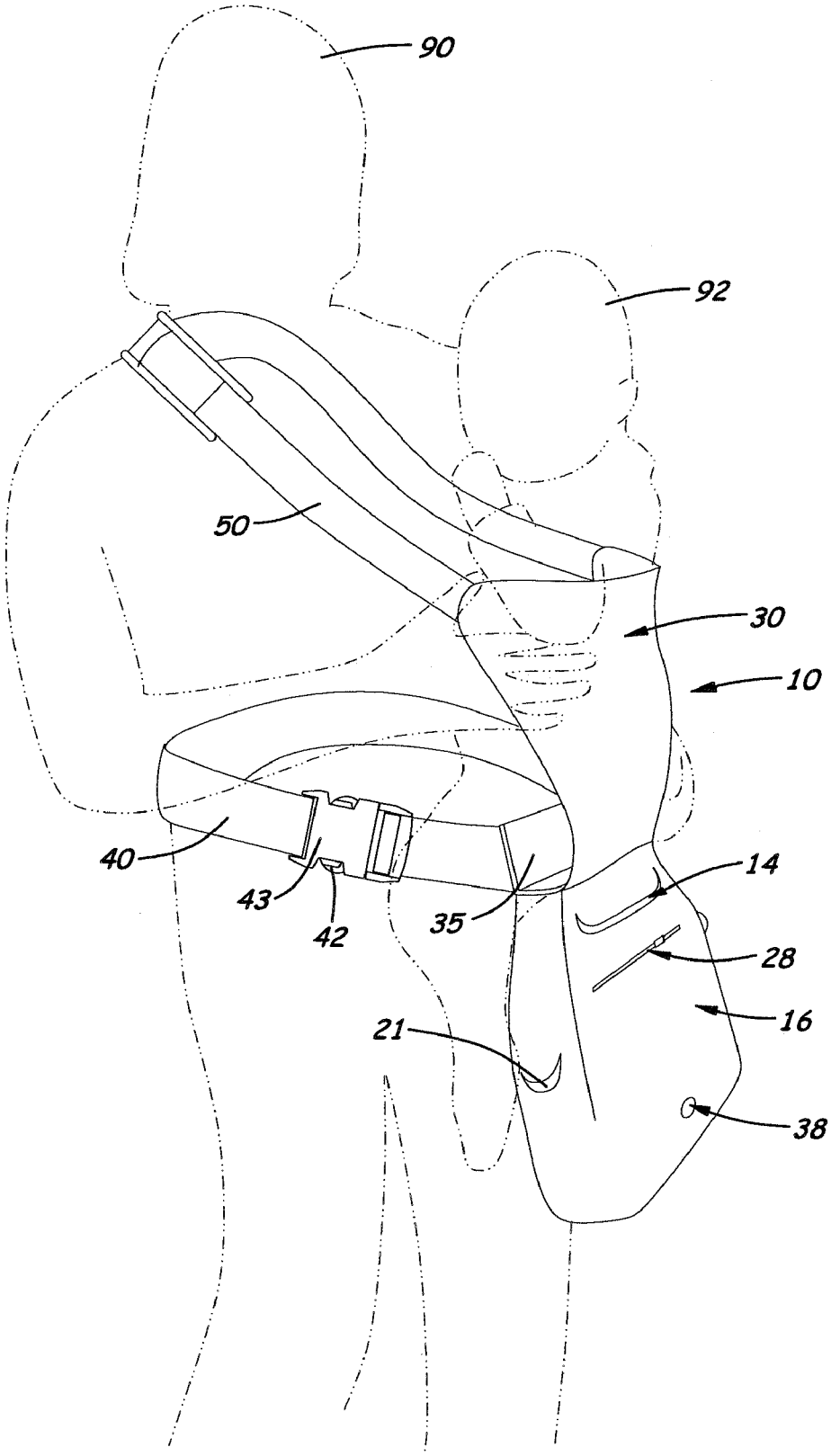
FIG. 6 is a side elevational view of the bag structure unfolded into an infant carrier and used to hold an infant.

To use the device as an infant carrier, the front edge of the waist flap 35 is detached from the bag's top panel 26 and folded upward to enable the primary strap 40 to be converted into a waist strap capable of being worn around an adult's waist. Male and female slide connectors 42, 43 are attached to the ends of the primary strap 40 to hold the primary strap 40 around the adult's waist. The connectors 38, 39 are disconnected so that the main cover 30 may be folded upward and extended above the bag structure 12. The pouch 32 in the main cover 30 is pulled outward and fully inverted so that the secondary strap 50 is exposed. The secondary strap 50 is then adjusted in length and extends around the user's neck so that the main cover 30 is held upward and over the user's chest. The main cover 30 may now act as a back support for an infant sitting on the top panel 26 of the bag structure 12 as shown in FIGS. 2 and 6. When an infant 92 or small child is placed onto the top panel 26, he or she is held closely against an adult's torso and the infant's legs straddle the waist flap 35.

As shown in FIGS. 1, and 3-5, the bag structure 12 is pear-shaped with a narrow upper portion 13A and a wide lower portion 13B. The pear-shaped feature is important because it allows the upper portion 13A to curve and conform with the user's waist, while the lower portion 13B remains relatively flat to allow more cargo to fill the lower portion 13B. The main cover 30 is also pear-shaped and complementary in shape to the outer surface of the bag structure 12. As stated above, the lower portion of the main cover 30 is pulled upward and partially wrapped around mid-torso to securely hold the infant 92 on the carrier 10. The width of the top panel 26 and the upper portion of the main cover 30 is less than the width of the lower portion of the bag structure 12 and the main cover 30 so that the infant's legs do not rub against the main cover 30 when pulled upward and around the infant 92.

Formed on the front panel 16 is a front sleeve pocket 28. Attached to the opening 29 of the sleeve pocket 28 is an optional slide connector. Formed adjacent to the bottom panel 24 of the bag structure 12 is a bottom pocket 63. A sliding connector 65 is used to close the opening 64 to the bottom pocket 63. Formed on the opposite side panels 20, 22 are two side pockets pockets 21, 23, respectively. Each side pocket 21, 23 may be selectively opened or closed while an infant 92 is being transported. Formed on the back panel 18 of the bag structure 12 is a narrow sleeve pocket 63 designed to hold a folded blanket or diaper.

Figure 7:
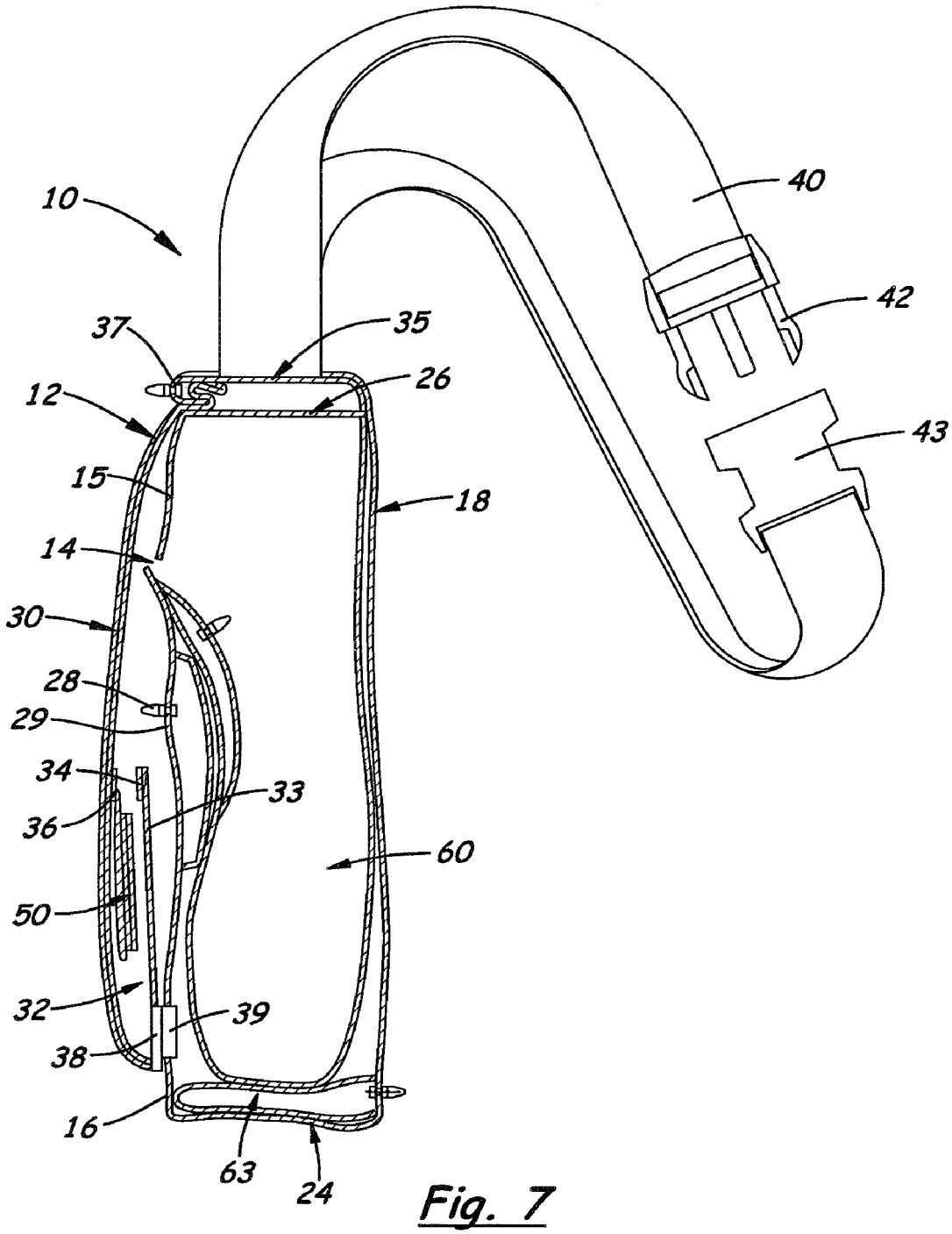
FIG. 7 is a sectional side elevational view of the invention taken along line 7-7 in FIG. 3.

As stated above, formed on the main cover 30 is an interior pouch 32. As shown in FIG. 7, the pouch 32 extends upward approximately one-half the height of the main cover 30. Attached to the inside surfaces of the inside panel 33 of the main cover 30 that forms the pouch 32 and the inside surface of the main cover 30 is a pair of hook and loop connectors 34, 36, respectively, used to close the pouch 32.

Figure 8:
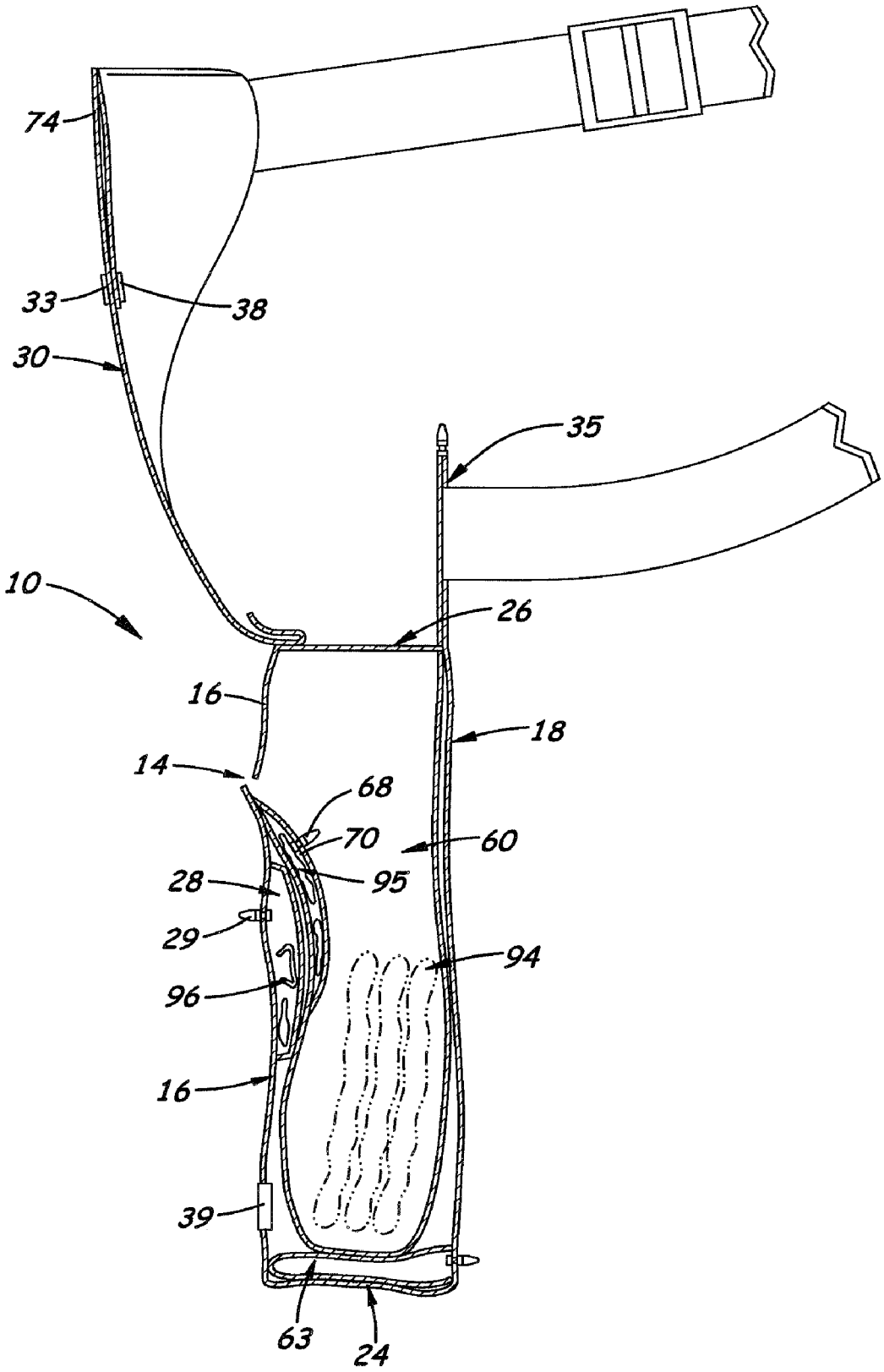
FIG. 8 is a sectional side elevational view of the invention taken along line 8-8 in FIG. 5.

In the preferred embodiment, the bag structure 12 measures approximately 20 inches in height, 9-18 inches in width (upper portion, lower portion, respectively), and 6 inches in depth. The top panel 26 measures approximately 9 inches in width and 4 inches in depth. The main pocket 60 is sufficient in size to accommodate diapers 94 as shown in FIG. 8. The primary strap 40 is approximately 1½ inches in width and 24 to 48 inches in length. The secondary strap 50 is approximately 1½ inches in width and 20 to 40 inches in length. The length of the main cover 30 is sufficient to cover the main opening 14, but also to extend upward to cover the infant's lower back. In the preferred embodiment, the main cover 30 is approximately 14 inches in length. The front sleeve pocket 28 is sufficient in size to accommodate safety clips 96 and other small items used with an infant 92.

The bag structure 12 is made of any washable durable material, such as 500 denier cotton or polyester with an internal liner made of nylon or nylon/cotton blend, etc. During use, diapers 94 are placed on edge inside the main pocket 60.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A combination diaper bag and infant carrier, comprising:

a. a bag structure that includes a front panel, a rear panel, a top panel and two opposite side panels, said top panel includes a rear edge and a front edge, said bag structure including a main pocket with an opening;

b. a main cover attached to said bag structure and extending downward over said front panel of said bag structure when said bag structure is used as a diaper bag to cover said opening to said main pocket on said bag structure, said main cover may be selectively extended upward and above said top panel when said bag structure is used as an infant carrier said main cover includes an inside surface with an interior pouch with a pouch opening formed thereon;

c. a waist flap including a rear edge and a front edge, said waist flap being longitudinally aligned with said rear edge and being securely attached to said top panel of said bag structure and selectively attached along said front edge to said rear edge of said top panel so that said waist flap may be selectively extended upward in a perpendicularly aligned position from said top panel or folded downward and longitudinally aligned over said top panel;

d. means for selectively holding said waist flap in a folded downward and longitudinally aligned over said top panel;

e. a length adjustable primary strap longitudinally aligned with to said waist flap so that when said waist flap is folded downward and longitudinally aligned over said top panel, said primary strap may extend upward and be used as a shoulder strap or when said waist flap is extended upward from said top panel, said primary strap may be aligned perpendicular to said bag structure and used as a waist strap, said primary strap being sufficient in length to extend around a user's shoulder to support said bag structure;

f. a length adjustable secondary strap temporarily stored inside and attached to said interior pouch, said secondary strap able to be selectively pulled from said pouch and sufficient in length to extend around the user's neck when said waist flap is extended upward from said top panel; and, g. whereby when said main cover is extended downward over said front panel of said bag structure and said waist flap is folded downward over said top panel, said primary strap may be vertically aligned and extended upward and over shoulder thereby enabling said bag structure to be used as a diaper bag, or when said main cover is pulled upward and said pouch is inverted and said secondary strap is extended around the user's neck and said selectively attached edge of said waist flap is detached from said top panel and said primary strap is placed around the user's waist, said bag structure may be used as an infant carrier by placing an infant over said top panel and folding said main cover upward around the buttocks and back of the infant and pulling said secondary strap from said interior pouch and extending said secondary strap around the neck of a user.

2. The combination diaper bag and infant carrier, as recited in claim 1, wherein said means for selectively holding said waist strap in a downward longitudinally position over said top panel is a slide connector.

3. The combination diaper bag and infant carrier, as recited in claim 1, wherein said means for selectively holding said waist strap in a downward longitudinally aligned position over said top panel is a slide connector.

4. The combination diaper bag and infant carrier, as recited in claim 1, further including means for selectively attaching said main cover to said front panel of said bag structure.

5. The combination diaper bag and infant carrier, as recited in claim 2, further including means for selectively attaching said main cover to said front panel to hold said main cover in an extended downward position over said front panel.

6. The combination diaper bag and infant carrier, as recited in claim 1, further including a bottom transversely aligned pocket formed on said bag structure.

7. The combination diaper bag and infant carrier, as recited in claim 1, further including at least one side pocket formed on said bag structure.

8. The combination diaper bag and infant carrier, as recited in claim 6, further including at least one side pocket formed on said bag structure.

9. The combination diaper bag and infant carrier, as recited in claim 1, further including a rear vertical pocket formed on said rear panel of said bag structure.

10. The combination diaper bag and infant carrier, as recited in claim 6, further including a rear vertical pocket formed on said rear panel of said bag structure.

11. The combination diaper bag and infant carrier, as recited in claim 8, further including a rear vertical pocket formed on said rear panel of said bag structure.

12. The combination diaper bag and infant carrier, as recited in claim 1, wherein said bag structure is pear-shaped when viewed from a side elevational view.

13. A combination diaper bag and infant carrier, comprising:

a. a bag structure that includes a front panel, a rear panel, a top panel, a bottom panel, and opposite side panels, said bag structure also includes a main pocket with a main opening formed on said front panel to provide access to said main pocket, said top panel includes a rear edge;

b. a main cover attached to said bag structure, said main cover extends downward over said front panel of said bag structure to cover said main opening to said main pocket, said main cover includes an inside surface with a pouch opening formed thereon that creates an interior pouch formed on said main cover;

c. a waist flap having a front edge and a rear edge, said waist flap being longitudinally aligned over said top panel with said rear edge being securely attached to said rear edge of said top panel, said front edge of said waist flap being selectively attached and detached to said top panel thereby enabling said waist flap to be selectively folded in a upward or downward position on said top panel;

d. a length adjustable primary strap longitudinally aligned and only attached to said waist flap so that when said waist flap is moved from a horizontal position to a vertical position over said top panel, the orientation of said primary strap also changes thereby enabling said primary strap to be used as a shoulder strap or a waist strap, said primary strap being sufficient in length to extend over the user's shoulder or waist;

e. an interior pouch located inside said main cover, said interior pouch includes an inside surface; and, f. a length adjustable secondary strap attached at its opposite ends to said inside surface of said pouch located inside said main cover.

14. The combination diaper bag and infant carrier, as recited in claim 13, wherein said front edge of said waist flap is selectively attached or detached to said top panel by a slide connector.

15. The combination diaper bag and infant carrier, as recited in claim 13, further including means for selectively attaching said main cover to said front panel of said bag structure.

16. The combination diaper bag and infant carrier, as recited in claim 13, further including at least one side pocket formed on said bag structure.

17. The combination diaper bag and infant carrier, as recited in claim 16, further including a bottom transversely aligned pocket formed on said bag structure.

18. The combination diaper bag and infant carrier, as recited in claim 13, wherein said pouch opening enables said secondary strap to be pulled to invert and extend said main cover upward from said bag structure when used as an infant carrier.

19. A combination diaper bag and infant carrier, comprising:

a. a bag structure that includes a front panel, a rear panel, a top panel and two opposite side panels, said top panel includes a rear edge and a front edge, said bag structure including a main pocket with an opening;

b. a main cover attached to said bag structure and extending downward over said front panel of said bag structure, said main cover includes an inside surface with an interior pouch with a pouch opening formed thereon;

c. a waist flap disposed over said top panel of said bag structure, said waist flap includes a rear edge and a front edge, said rear edge of said waist flap being pivotally attached to said rear edge of said top panel;

d. means for selectively attaching and holding said waist flap in a folded downward and longitudinally aligned position over said top panel;

e. a length adjustable primary strap that can be extended either around the user's shoulder or around the user's waist, said primary strap being longitudinally aligned and only attached to said waist flap so that the vertical and horizontal orientation of said primary strap may be adjusted by folding downward or upward extending said waist flap over said top panel, and;

f. a length adjustable secondary strap attached to said main cover, said secondary strap being sufficient in length to extend around the user's neck when said waist flap extended upward from said top panel.

* * * * *